US009962986B2

(12) United States Patent
Terao

(10) Patent No.: US 9,962,986 B2
(45) Date of Patent: May 8, 2018

(54) SHEET POST PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yasunobu Terao, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 94 days.

(21) Appl. No.: 14/597,376

(22) Filed: Jan. 15, 2015

(65) Prior Publication Data

US 2016/0207296 A1 Jul. 21, 2016

(51) Int. Cl.
*B42C 9/00* (2006.01)
*B65H 37/02* (2006.01)

(52) U.S. Cl.
CPC ..... *B42C 9/0075* (2013.01); *B65H 37/02* (2013.01); *B65H 2301/4213* (2013.01); *B65H 2301/5113* (2013.01); *B65H 2801/27* (2013.01)

(58) Field of Classification Search
CPC ..... B32B 37/12; B32B 37/14; B32B 41/00; B41F 27/1275; B42C 9/00; B42C 9/0006; B42C 9/0012; B42C 9/0025; B42C 9/0031; B42C 9/0037; B42C 9/0056; B42C 9/0062; B42C 9/0075; B42C 9/0081; B42C 9/0087
USPC ..... 156/350, 361; 270/52.18, 58.07, 58.08, 270/58.09; 271/33; 412/8, 37, 901
See application file for complete search history.

(56) References Cited

U.S. PATENT DOCUMENTS 5,899,649 A * 5/1999 Kohtani ..... B42C 9/0075 412/11
2015/0063953 A1* 3/2015 Taguchi ..... B42C 19/02 412/37

* cited by examiner

*Primary Examiner* — George Koch
(74) *Attorney, Agent, or Firm* — Amin, Turocy & Watson LLP; Gregory Turocy

(57) ABSTRACT

In accordance with an embodiment, a sheet post processing apparatus comprises a processing tray, a gluing section and a control section. Sheets are placed one by one in the processing tray. The gluing section enables glue to be adhered to the glue binding margin part of the sheets already placed in the processing tray. The control section includes a glue supply mode for supplying glue parts in such a manner that a glue part, which is different from a waiting glue part waiting for a next gluing when the previous glue binding is ended, is supplied to a glue adhering section of a first sheet for gluing with a second sheet through the gluing section.

8 Claims, 10 Drawing Sheets

SHEET POST PROCESSING APPARATUS

FIELD

Embodiments described herein relate generally to a technology of binding a plurality of sheets with glue.

BACKGROUND

In the past, there has been proposed a sheet post processing apparatus (Finisher) which sequentially receives the sheet subjected to printing processing discharged from an image forming apparatus and then carries out a binding processing. As a binding section carrying out a binding processing, there is a glue binding section. Every time a new sheet (sheet except the last one) is stacked in a processing tray, the glue binding section enables glue to be adhered to a specific position (a part corresponding to the binding margin) of the sheet at the uppermost position. Then, every time stacking a new sheet one by one on the sheet already discharged, a processing for adhering glue to the part corresponding to the binding margin is carried out.

The glue to be used by the glue binding section includes the liquid glue, the solid glue, the tape glue and the like. The glue waits in a state in which the adhering surface thereof is exposed so as to be capable of being adhered to a sheet quickly.

However, in a case in which the glue binding processing has not been carried out for a long time, the glue in the waiting state gets bad because the adhering surface thereof is dry, and the gluing strength is reduced. Thus, the gluing strength of the glue for bonding a first sheet and a second sheet is insufficient, and as a result, the first sheet may be peeled off.

Therefore, it is desired to bond the first sheet and the second sheet with sufficient gluing strength.

DETAILED DESCRIPTION

In accordance with one embodiment, a sheet post processing apparatus comprises: a processing tray, a gluing section and a control section. Sheets are placed one by one in the processing tray. The gluing section enables glue to be adhered to the glue binding margin part of the sheet already placed in the processing tray. The control section includes a glue supply mode for supplying glue parts in such a manner that a glue part, which is different from a waiting glue part waiting for a next gluing when the previous glue binding is ended, is supplied to a glue adhering section of a first sheet for gluing with a second sheet through the gluing section.

Hereinafter, the sheet post processing apparatus according to the present embodiment is described in detail with reference to the accompanying drawings.

Figure 1A:
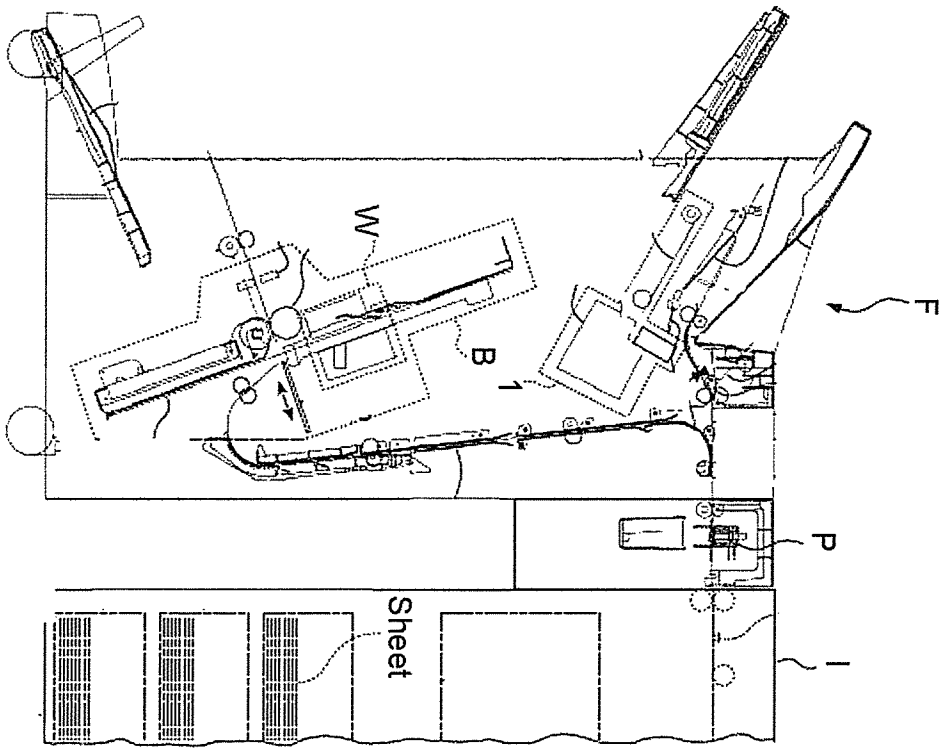
FIG. 1A is a schematic longitudinal section view of a sheet post processing apparatus.

In FIG. 1A, a sheet post processing apparatus F, which is attached to an image forming apparatus I, roughly comprises, for example, a glue binding processing device 1, a folding processing section B, a stapler W, a drilling section P and the like as processing fuctions. Herein, as an example, the sheet post processing apparatus F which comprises the glue binding processing device 1, the folding processing section B, the stapler W, the drilling section P and the like is exemplified. However, the present invention is not limited to this. As long as it is provided with at least the glue binding processing device 1, the configuration of the sheet post processing apparatus F is not limited.

For example, the sheet post processing apparatus F receives the sheet discharged from the image forming apparatus I which is connected to be capable of communicating with the sheet post processing apparatus F, and performs various processing such as a binding processing, a folding processing, a drilling processing and the like on the sheet.

Figure 1B:
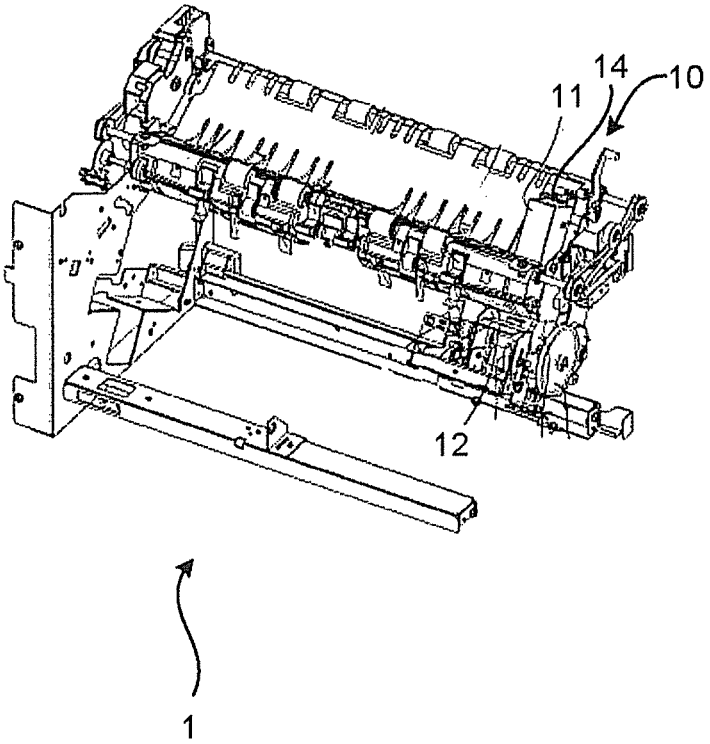
FIG. 1B is a perspective view illustrating a glue binding processing section of the sheet post processing apparatus according to an embodiment.
Figure 2:
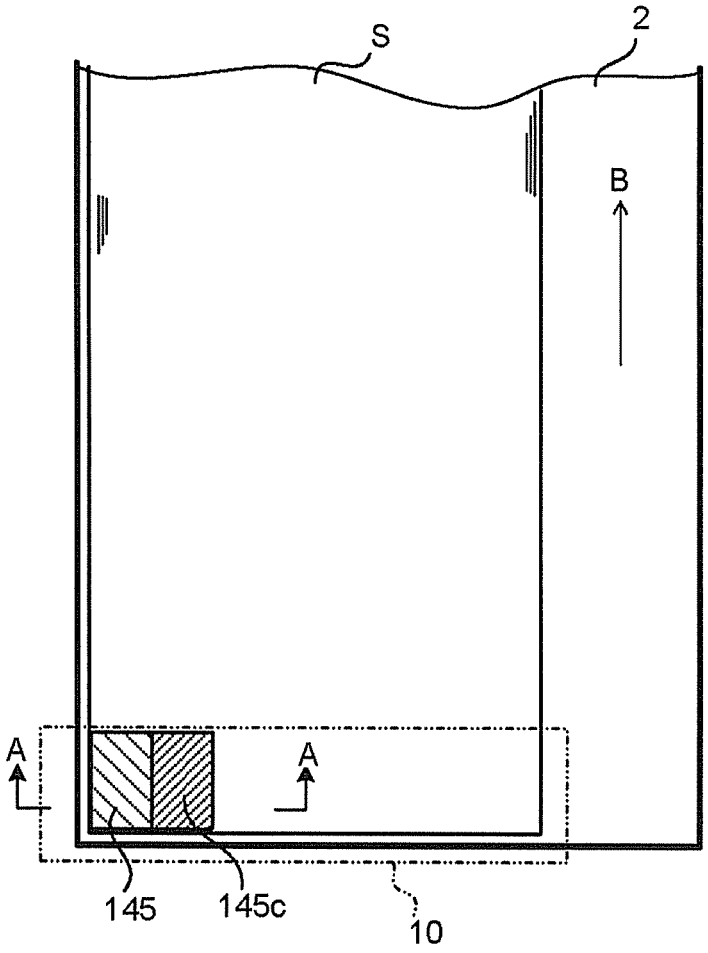
FIG. 2 is a plan view illustrating a state in which sheets in a processing tray are bound with glue through a long-coating process.

FIG. 1B is a perspective view illustrating a glue binding processing section of a sheet post processing apparatus according to the embodiment. In addition, FIG. 1B is a perspective view illustrating a binding processing section 1 seen from a processing tray side, and is also a perspective view in which the peripheral members of the binding processing section are removed. FIG. 2 is a plan view illustrating a state in which sheets in the processing tray are bound with glue through a long-coating process.

The post processing apparatus F roughly comprises, for example, the binding processing section 1, a folding processing section, a stapler, a drilling section and the like as processing functions. However, the present invention is not limited to this. As long as it is provided with at least the binding processing section 1, the configuration of the post processing apparatus F is not limited.

The binding processing section 1 is provided with a gluing section 10 carrying out gluing processing on the top surface of the sheet S stacked in a processing tray 2 (refer to FIG. 2). A bundle of sheets subjected to binding processing in the processing tray 2 is discharged in a direction indicated by an arrow B. Every time a sheet S is stacked in the processing tray 2, the binding processing section 1 carries out gluing processing on the top surface of the sheet S with the gluing section 10. However, for example, in a case of desiring to bind a sheet bundle of 10 sheets, the gluing processing is not carried out on the top surface of the tenth sheet (the sheet which is the tenth stacked and on the uppermost)

The gluing section 10 includes a glue material imparting section 14 that is accommodated in a holder 11 in an exchangeable manner, and a cradle 12 which is fixedly arranged below the holder 11.

Figure 3:
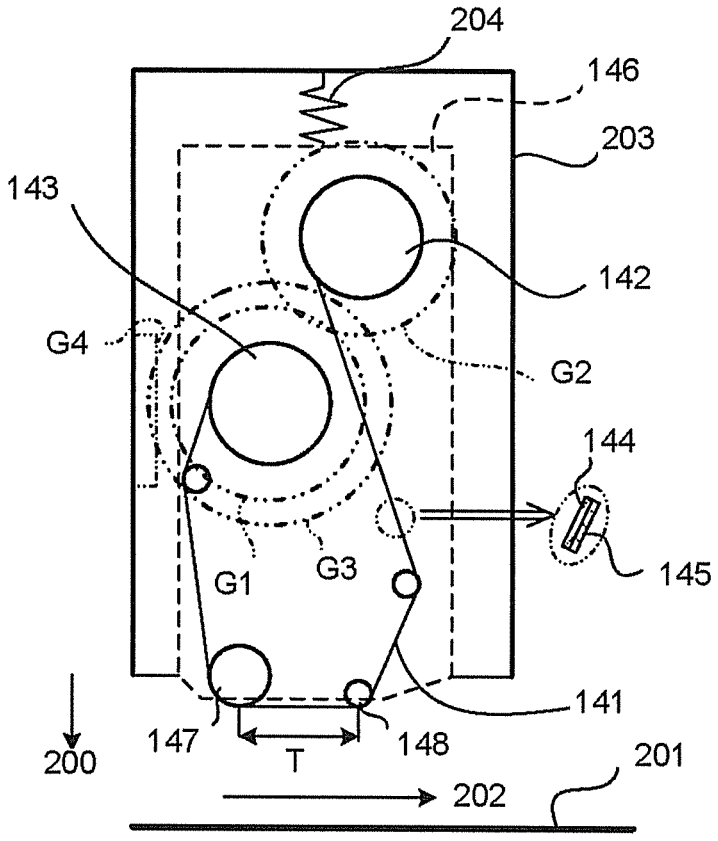
FIG. 3 is a schematic diagram illustrating an example of a gluing unit formed by tape glue.

The glue material imparting section 14 enables the liquid glue, solid glue, tape glue and the like to be adhered to a sheet. An example of the glue material imparting section 14 using the tape glue is shown in FIG. 3.

The glue material imparting section 14 shown in FIG. 3 takes a pressure-sensitive adhesive tape (hereinafter referred to as an adhesive tape for short) 141 as glue. The adhesive tape 141 is wound into a roll on a feed reel 142, and one end of the adhesive tape 141 is wound on a winding reel 143. In the adhesive tape 141, a transferred glue part 145 for forming glue is adhered to one surface of a roll film 144 in a peelable manner. A base material 145 having a double-sided adhesiveness of which the part transferred to the adherend surface in a transfer area is able to be peeled off from the roll film 144.

The feed reel 142 and the winding reel 143 are rotatably supported by a substrate 146, and are stretched via rollers 147 and 148 that are arranged at the front end of the substrate 146. In a pressing transfer area T having a length between the roller 147 and the roller 148, the substrate 146 is pressed towards the direction indicated by an arrow 200, and the transferred glue part 145 of the adhesive tape 141 is pressed against a transferred surface 201, and then when the substrate 146 is returned upward, the transferred glue part 145 in the pressing transfer area T is to be transferred to a sheet serving as the transferred surface 201. Further, the substrate 146 is slid in a direction indicated by an arrow 202 in a state in which the transferred glue part 145 is pressed against the transferred surface 201, and then when the substrate 146 is returned upward, the transferred glue part 145 having a sliding length of the substrate 146 is to be transferred to the transferred surface 201.

In the present embodiment, the substrate 146 is arranged inside an exterior case 203 to be capable of moving in the vertical direction. In FIG. 3, a spring member 204 is arranged to energize the substrate 146 downward against the exterior case 203. A first gear G1 is coaxially fixed on the winding reel 143, and a second gear G2 is coaxially fixed on the feed reel 142. The first gear G1 and the second gear G2 are engaged with each other. Thus, if the adhesive tape 141 is pulled in a winding direction thereof, the first gear G1 is rotated anticlockwise, and the winding reel 143 is rotated clockwise together with the second gear G2, as a result, the adhesive tape 141 is wound on the winding reel 143.

A third gear G3 is arranged on the winding reel 143 through a one-way clutch mechanism (not shown) coaxially with the first gear G1. A rack gear G4 which is engaged with the third gear G3 is arranged on the inner side of the case 203.

If the third gear G3 is rotated clockwise, the one-way clutch connects the third gear G3 with the winding reel 143, and in this way, the winding reel 143 winds the adhesive tape 141 with the rotation force of the third gear G3.

On the contrary, if the winding reel 143 is rotated clockwise, the one-way clutch releases the connection of the third gear G3 with the winding reel 143, and then only the winding reel 143 rotates in the winding direction.

Figure 4:
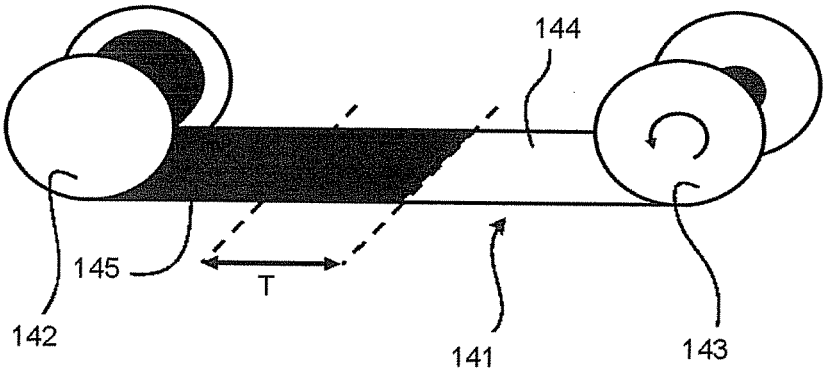
FIG. 4 is a diagram illustrating the tape glue.

If the substrate 146 is pressed downward by the spring force of the spring member 204 against the exterior case 203, the third gear G3 is rotated clockwise through the engagement with the rack gear G4, and the adhesive tape 141 is wound on the winding reel 143. That is, during the period when the exterior case 203 is being moved upward after the base material 145 is transferred, in synchronization with the pressing of the substrate 146 downward by the spring force of the spring member 204, the adhesive tape 141 is wound on the winding reel 143 in a given amount (the position of the transferred glue part 145 in the pressing transfer area T, as shown in FIG. 4).

Further, when the glue material imparting section 14 is slid in the direction indicated by the arrow 202 to adhere glue, even if the rotation force in the winding direction is applied to the winding reel 143, it is also guaranteed that the winding reel 143 can be rotated freely because the winding reel 143 is in a non-connected state with the third gear G3 through the action of the one-way clutch.

Figure 5:
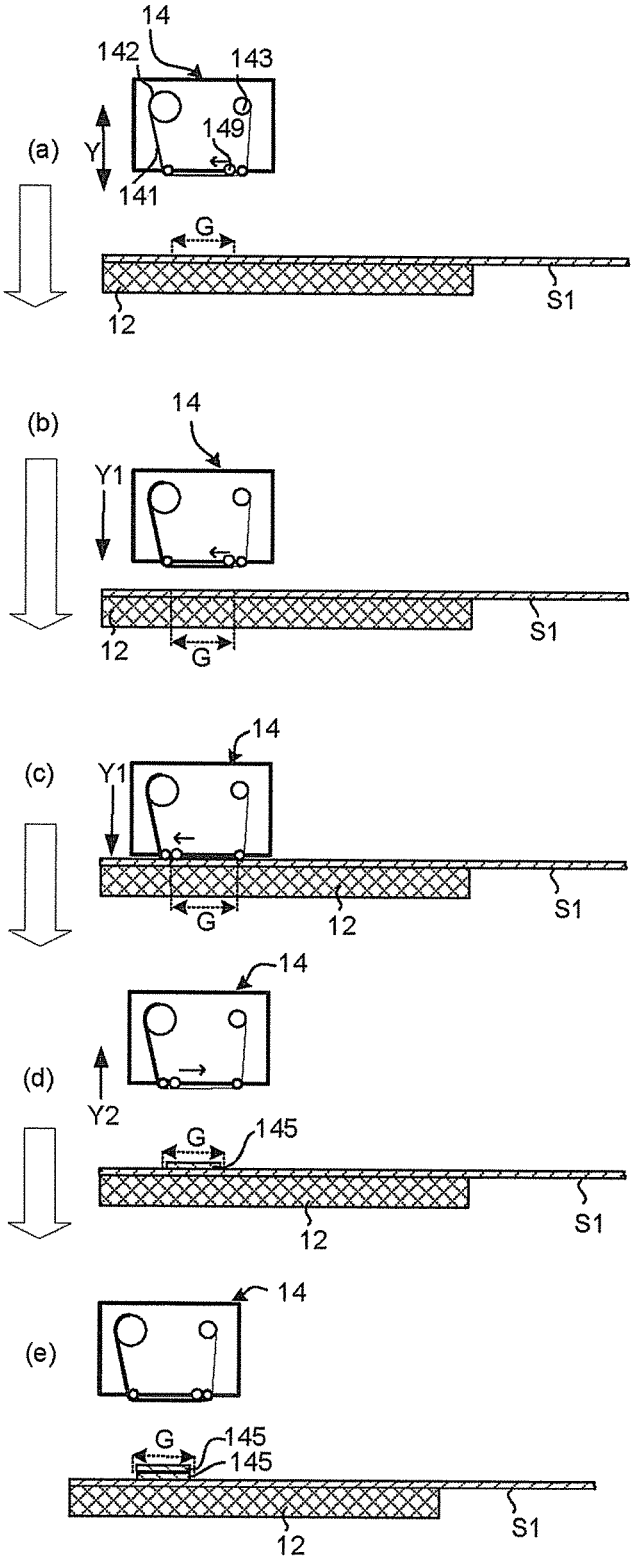
FIG. 5 is a diagram illustrating a re-coating process in which glue having the length of the binding margin part is overlapped and adhered to a first sheet.
Figure 6:
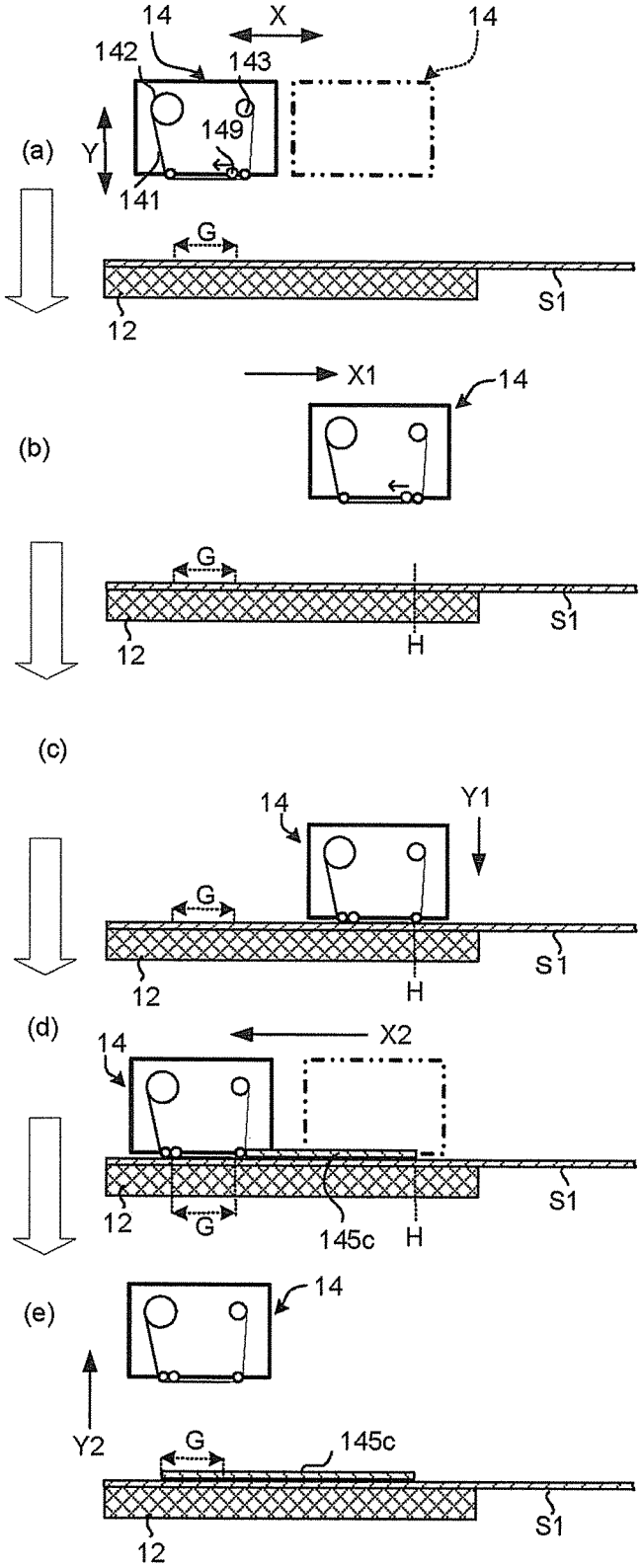
FIG. 6 is a diagram illustrating a long-coating process in which glue is adhered to the first sheet from a part deviated from the binding margin part to the binding margin part for a long distance.

Though in the configuration shown in FIG. 3, the transferred glue part 145 is transferred to the transferred surface 201 (sheet S) through the pressing force, the present invention is not limited to this. As shown in FIG. 5 and FIG. 6, a pressing roller 149 moving within the pressing transfer area T is arranged on the backside of the roll film 144, and the transferred glue part 145 can be adhered to the sheet S more firmly by pressing the transferred glue part 145 against the sheet S while the pressing roller 149 moves.

Figure 7:
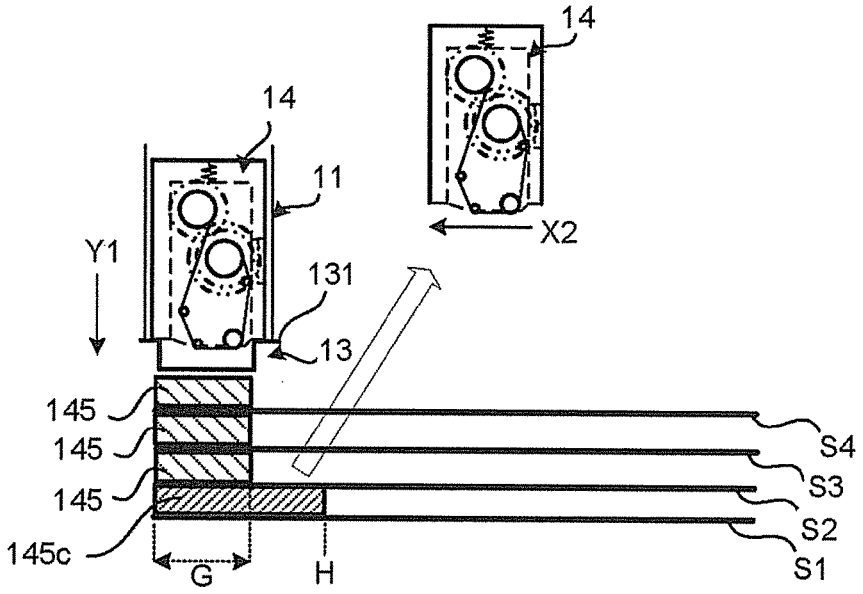
FIG. 7 is a cross section viewing from the arrow direction of the A-A of FIG. 2.

Further, when carrying out glue binding after a next sheet is placed on the sheet already placed in the processing tray 2, the upper sheet is pressed downward by a pressing plate 13 before the transferred glue part 145 is adhered to the upper sheet. In this way, the upper sheet can be strongly adhered to a lower sheet with the transferred glue part 145 adhered therebetween. The pressing plate 13 is formed in a concave shape in its longitudinal section as shown in FIG. 7. The lower end of the holder 11 is contacted with the upper surface of a flange 131 of the pressing plate 13, and the pressing force when the holder 11 moves downward is applied to the sheet S.

As shown in FIG. 4, a transferred glue part 145 which is positioned at the pressing transfer area T and serves as a waiting glue part waiting to be adhered in a next glue adhesion is exposed. For this reason, if the transferred glue part 145 of the pressing transfer area T is likely to be dry and in an exposed state for a long time (long period), the gluing strength is reduced. However, the glue in the transfer part 145 following the rear of the pressing transfer area T other than the pressing transfer area T is housed in the holder, and is hardly to be exposed to air, and thus the gluing strength is not reduced. Further, the "waiting glue part" described above refers to the glue to be subjected to a gluing processing on the next sheet. For example, when described using FIG. 3 in the present embodiment, the glue which is exposed outside and positioned at the pressing transfer area T having a length between the rollers 147 and 148 is equivalent to the waiting glue part.

Thus, in a case in which the gluing processing on a next sheet has not been carried out for a long time, there is a possibility that the adhesive force is reduced because the "waiting glue part" is dry.

Thus, in the present embodiment, there provided is a glue supply mode including a re-coating mode in which the transferred glue part 145 is overlapped and coated on a glue adhering section G of the first sheet S for adhering glue for glue binding of the first sheet S, and a long-coating mode in which the transferred glue part 145 is coated from a position (start point) that is deviated from the glue adhering section G towards the glue adhering section G of the first sheet S.

In the re-coating mode, the transferred glue part 145 at uppermost position isn't exposed to air. Moreover, in the long-coating mode, the transferred glue part 145 in the pressing transfer area T which has a possibility that the gluing strength thereof is reduced is adhered to the part deviated from the glue adhering section G, while the transferred glue part 145 having sufficient gluing strength is adhered to the glue adhering section G. In this way, a first sheet S1 is firmly bound with a second sheet S2 through the transferred glue part 145 that is adhered to the glue adhering section G.

FIG. 5 is a diagram illustrating a glue adhering process in the re-coating mode, and FIG. 6 is a diagram illustrating a glue adhering process in the long-coating mode. The glue material imparting section 14 is capable of moving in the direction indicated by an arrow X and the direction indicated by an arrow Y. Further, it is assumed that the sheets S subjected to the printing processing are sent from the image forming apparatus sequentially so as to bind a plurality of the sheets S with glue.

In the re-coating mode shown in FIG. 5, first, the glue material imparting section 14 is maintained at a waiting position in a waiting process (a) and waits for until the first sheet S1 is sent to the processing tray 2. If the first sheet S1 is placed in the processing tray 2, a lowering process (b) for lowering the glue material imparting section 14 in the direction indicated by an arrow Y1 is carried out to glue the first sheet S1. When the glue material imparting section 14 is lowered to the first sheet S1, a first time gluing process (c) is carried out. The gluing process is carried out by horizontally moving the pressing roller 149 in an arrow direction. Next, in order to carry out a second time gluing process (as a new transferred glue part 145 is moved to the pressing transfer area T), a lifting process (d) for temporarily lifting the glue material imparting section 14 in the direction indicated by an arrow Y2 is carried out. In the first time gluing process (c), a transferred glue part 145 (a first transferred glue part 145*a*) is adhered to the glue adhering section G on the first sheet S.

After the lifting process (d) for lifting the glue material imparting section 14, the lowering process (b) for lowering the glue material imparting section 14 is carried out again. Then, similar to the first time gluing process (c), a second gluing process is carried out. After the second time gluing process is completed, if a second time lifting process (e) is carried out, a transferred glue part 145 (a second transferred glue part 145*b*) is adhered to the first transferred glue part 145*a* on the first sheet S1. Then, the glue material imparting section 14 waits at the waiting position until the second sheet S2 is sent.

In the long-coating mode shown in FIG. 6, the glue material imparting section 14 waits in the waiting process (a). Next, in order to perform a long-coating for the transferred glue part 145 on the first sheet S1, a horizontal movement process (b) for moving the glue material imparting section 14 in the direction indicated by an arrow X1 to a long-coating start position H deviated from the glue adhering section G is carried out.

If the horizontal movement process (b) of the glue material imparting section 14 is ended, subsequently, the lowering process (c) for lowering the glue material imparting section 14 in the direction indicated by the arrow Y1 is carried out. When the lowering process (c) is ended, the glue material imparting section 14 is contacted with the first sheet S1 in a pressed state, and the front end of the transferred glue part 145 facing the pressing transfer area T is positioned at the long-coating start position H.

Next, in order to perform long-coating for the transferred glue part 145, the glue material imparting section 14 is horizontally moved in the direction indicated by an arrow X2, and a long-coating process (d) for adhering a transferred glue part 145 (a long-coating transferred glue part 145*c*) from the long-coating start position H to the end of the glue adhering section G is carried out.

If the long-coating process (d) is ended, the lifting process (e) for lifting the glue material imparting section 14 in the direction indicated by the arrow Y2 is carried out. Then, the glue material imparting section 14 waits at the waiting position until the second sheet S2 is sent.

As shown in FIG. 7, the transferred glue part 145 is directly adhered to the glue adhering section G on each of the sheets following the first sheet (S2, S3, S4 . . . ) similar to the case shown in FIG. 5.

During the period from a moment at which the adhesion is started to a moment at which the long-coating transferred glue part 145*c* reaches the glue adhering section G, the long-coating transferred glue part 145*c* to be adhered to the sheet S from the long-coating start position H of which the part having low gluing strength is adhered, and the gluing strength of the transferred glue part to be adhered to the glue adhering section G will be sufficient.

Though the long-coating start position H is preset, it may also be changed according to manual operation.

Whether to execute re-coating mode or long-coating mode is set by the user. Further, when a given period elapses after the glue binding is carried out, a mode that is already set is executed automatically. The given period is considered to be a period during which the glue is dry and the gluing strength is reduced. Generally, such a period can be set to be a relative long period such as several days, several weeks or one month by the user. Further, through the manual operation, even in the given period, the transferred glue part 145 of which the gluing strength is guaranteed in the re-coating mode or the long-coating mode can be adhered to the glue adhering section G.

Figure 8:
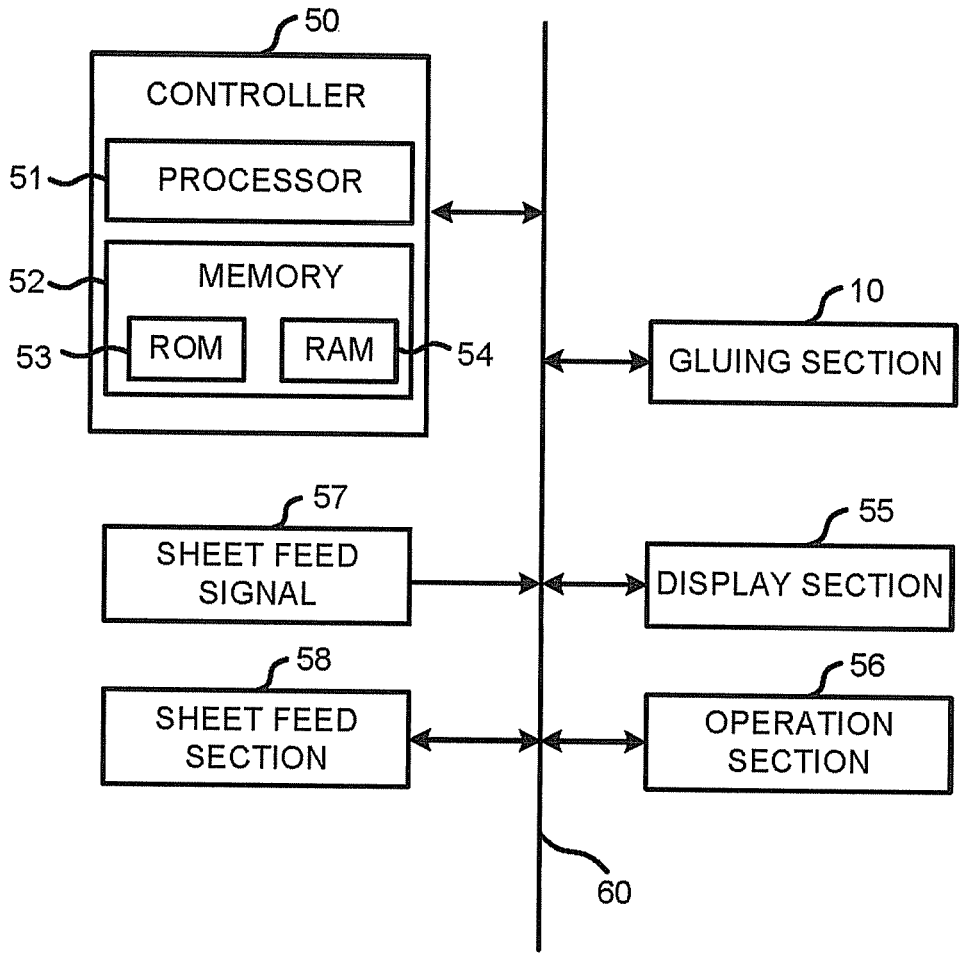
FIG. 8 is a control block diagram illustrating the glue binding processing section of the sheet post processing apparatus.

FIG. 8 shows a control block diagram of the sheet post processing apparatus.

In the sheet post processing apparatus, a controller 50, a sheet feed section 58, a gluing section 10, a display section 55 and an operation section 56 are connected with a bus line 60, and a sheet feed signal 57 from an image forming apparatus is input to the controller 50.

Whether to set a re-coating mode or to set a long-coating mode is displayed on the display section 55 and is selected through the operation section 56. Further, a manual operation for manually operating the re-coating mode or the long-coating mode is displayed on the display section 55 and can be selected through the operation section 56. The position of the long-coating start position H in the long-coating mode can be changed through the operation section 56.

The controller 50 comprises a processor 51 including a CPU (Central Processing Unit) or an MPU (Micro Processing Unit) and a memory 52.

The processor 51 which includes a timer starts the timer after the glue binding processing is ended. If the given period from the start of the timer elapses, either the re-coating mode or the long-coating mode is started. The given period is set to be a period equivalent to one during which the gluing strength is reduced in a state in which the glue to be used in the glue binding processing is exposed in the air. For example, it can be set to be a relative long period such as several days, several weeks or one month. The set processing of the given period is set by operating the operation section 56 by the user, or is recorded in the glue material imparting section 14 in advance and then is to be sent to the controller 50 if the glue material imparting section 14 is set in the holder 11.

The sheet feed signal 57 is output when the first sheet is to be sent to the sheet post processing apparatus after being printed by the image forming apparatus. When receiving the sheet feed signal 57, the controller 50 sets the re-coating mode or the long-coating mode. If the re-coating mode or the long-coating mode is executed on the first sheet S1, the time required for the gluing processing becomes longer. Thus, before the second sheet S2 is sent to the sheet processing tray 2, various processing in which the sheet feed section 58 is controlled to make the second sheet S2 to be temporarily stored in an intermediate tray and the like is carried out.

The memory 52, which is, for example, a semiconductor, comprises an ROM (Read Only Memory) 53 for storing various control programs and an RAM (Random Access Memory) 54 for providing a temporary work area for the processor 51. For example, the ROM 53 stores programs for executing the re-coating mode or the long-coating mode set based on various given periods.

Figure 9:
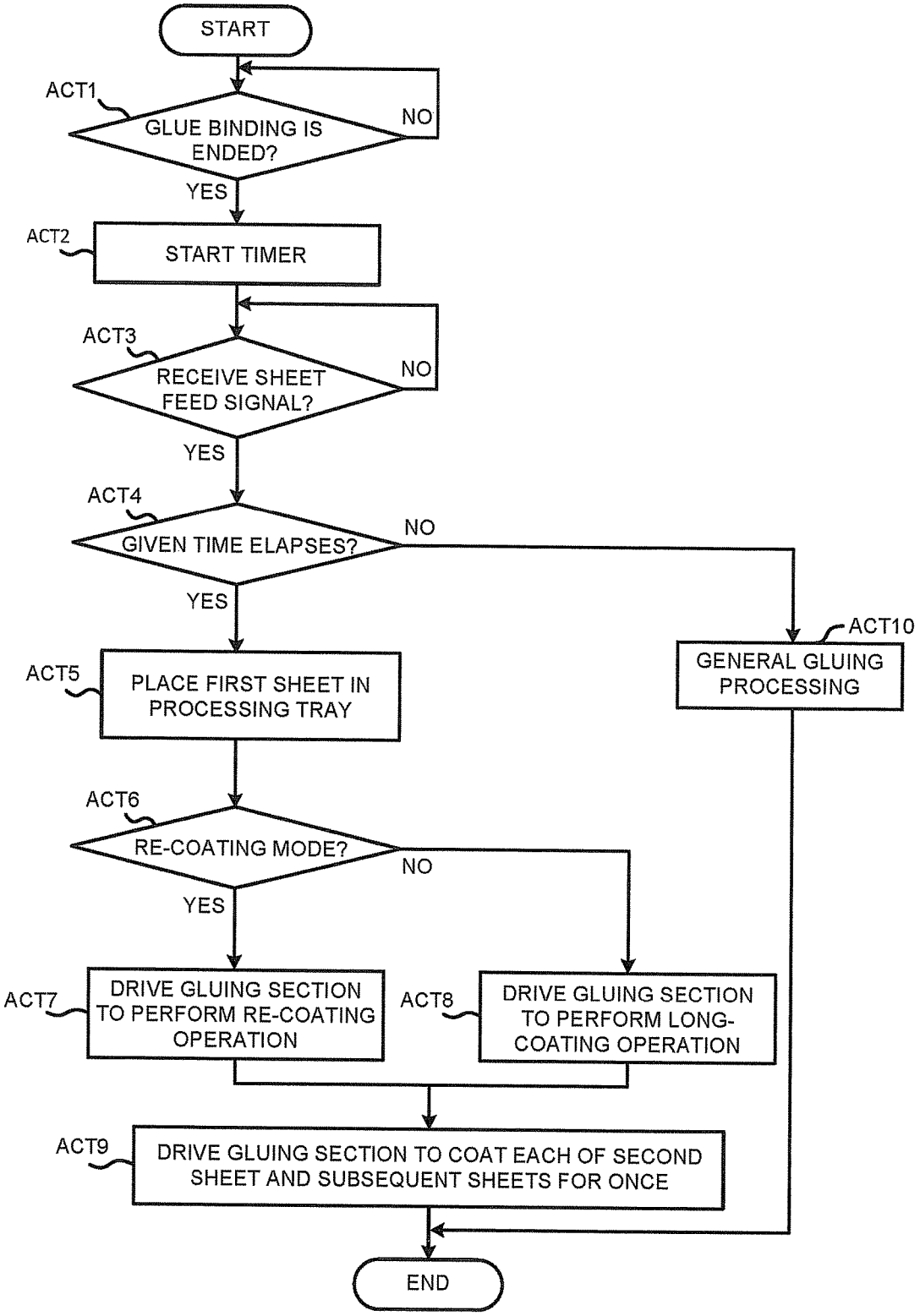
FIG. 9 is a flowchart illustrating a flow of glue binding processing in the glue binding processing section of the sheet post processing apparatus.

FIG. 9 is a flowchart illustrating a flow of re-coating or long-coating carried out by the glue material imparting section 14 for the first sheet S1 based on the control of the processor 51.

In ACT 1, it is determined whether or not the glue binding processing is ended. If it is determined in ACT 1 that the glue binding processing is ended (YES in ACT 1), ACT 2 is taken.

The timer is started in ACT 2, and then ACT 3 is taken.

In ACT 3, it is determined whether or not a sheet feed signal is received. If it is determined in ACT 3 that the sheet feed signal is received (YES in ACT 3), ACT 4 is taken.

In ACT 4, it is determined whether or not the given period elapses. That is, in a case in which a next glue binding processing is started after the previous glue binding processing is ended, it is determined, based on the timing of the timer, whether or not the given period to be a measurement of whether or not the glue in the glue material imparting section 14 initially adhered to the sheet is dry elapses. If it is determined in ACT 4 that the given period elapses (YES in ACT 4), ACT 5 is taken. If it is determined in ACT 4 that the given period doesn't elapse (NO in ACT 4), ACT 10 is taken. In ACT 10, a general gluing processing is carried out and then ended.

In ACT 5, a first sheet S1 is sent to and placed in the processing tray 2, and then ACT 6 is taken.

In ACT 6, it is determined whether or not the re-coating mode is set, and ACT 7 is taken if the re-coating mode is set (YES in ACT 6), while ACT 8 is taken if the long-coating mode is set (NO in ACT 6).

In ACT 7, the gluing section 10 is driven to carry out a re-coating process so that a transferred glue part 145 is recoated to the glue adhering section G of the first sheet S1 for twice, and then ACT 9 is taken.

In ACT 8, the gluing section 10 is driven to carry out a long-coating process. The long-coating process means that the transferred glue part 145*c* is adhered from the glue adhering start position H that is set to be deviated from the glue adhering section G to the end of the glue adhering section G with respect to the glue binding margin part (where the glue of the first sheet S1 is adhered). Thus, the transferred glue part adhered to the glue adhering section G has a sufficient gluing strength.

In ACT 9, the processing of coating the second sheet and each of the subsequent sheets with glue is carried out for once, and the processing of coating the sheet just before the last page with glue is also carried out for once. If the sheet of which the last page is stacked in the processing tray 2 is placed at the uppermost position, the pressing plate 13 shown in FIG. 7 applies a pressure force to the sheet at the uppermost position to glue each sheet through the transferred glue part 145 adhered to the glue adhering section G. Further, every time placing a next sheet on the sheet that is already placed in the processing tray 2 and to be adhered with a transferred glue part 145, a pressing processing of the pressing plate 13 may be carried out.

According to the present embodiment, if the liquid glue, the solid glue or the tape glue is exposed to air because it is exposed for a long period, the gluing strength is reduced due to the dryness of the liquid glue, the solid glue or the tape glue. The transferred glue part having low gluing strength cannot be directly used to contact with the second sheet unless a re-coating process or a long-coating process is carried out. Then, the glue having a sufficient adhesive strength is used to glue with a second sheet, and therefore, the first sheet cannot be peeled off from the second sheet.

It is exemplified that the processing described in FIG. 9 is carried out by executing the programs pre-stored in a storage area arranged in the controller 50 through the internal data processing processor. However, the present invention is not limited to this. Same programs may be downloaded to the MFP from a network. Alternatively, same programs recorded in a computer-readable recording medium may also be installed in the MFP. The form of the recording medium is not limited as long as the recording medium can store programs and is computer-readable. As the recording medium, for example, an RAM (Random Access Memory), an ROM (Read Only Memory), a DRAM, an SRAM (Static Random Access Memory), a VRAM (Video RAM), or a flash memory may be used.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet post processing apparatus, comprising:

a processing tray in which sheets are placed one by one;

a gluing section configured to enable glue to be adhered to a sheet surface of the sheet placed in the processing tray;

a control section configured to control the gluing section to adhere glue to a predetermined area of the sheet surface of the sheet except for a sheet just before the last sheet among a plurality of sheets in a sheet bundle, and overlappedly adhere glue to the predetermined area on a first sheet stacked in the processing tray among the plurality of sheets in the sheet bundle, and adhere glue for once to a predetermined area on a second sheet stacked on the first sheet and subsequent sheets;

wherein the control section includes a glue supply mode in which, in the sheet bundle, the number of times glue is re-applied onto the first sheet is greater than the number of times glue is re-applied onto the second sheet; and where the control section applies the glue supply mode in a case in which a next glue binding is to be started after a given period of time elapses from the moment the previous glue binding is ended.

2. The sheet post processing apparatus according to claim 1, wherein the control section includes a glue supply mode in which, in the sheet bundle, the number of times of the re-applying glue onto the first sheet is greater than the number of times of the re-applying glue onto the second sheet, the glue supply mode is a first mode in which the glue part is overlapped and adhered to the glue adhering section of the first sheet and the sheet post processing apparatus further comprising:

a reception section configured to receive either the first mode or a second mode in which the glue is started to be applied from the outside of the adhering region of the first sheet to the end of the adhering region serving as the glue supply mode, wherein the control section executes either of the first mode and the second mode received by the reception section.

3. The sheet post processing apparatus according to claim 2, wherein in the first mode, the control section moves a glue material imparting section of the gluing section with respect to the adhering region of the first sheet up and down for several times for recoating the adhering region with glue.

4. The sheet post processing apparatus according to claim 2, wherein in the second mode, the control section moves a glue material imparting section of the gluing section from a gluing start position which is deviated from the adhering region of the first sheet to the end of the adhering region while glue is being adhered.

5. The sheet post processing apparatus according to claim 2, wherein in the second mode, the control section may change the position where the gluing is to be started.

6. The sheet post processing apparatus according to claim 1, wherein the control section may change the given period.

7. A sheet post processing apparatus, comprising:

a processing tray in which sheets are placed one by one;

a gluing section configured to enable glue to be adhered to a sheet surface of a sheet placed in the processing tray; and a control section configured to control the gluing section to adhere glue to a predetermined area of the sheet surface of the sheet except for a sheet just before the last sheet among a plurality of sheets in a sheet bundle, and adhere glue to an area adjacent to the predetermined area on the first sheet stacked in the processing tray among the plurality of sheets in the sheet bundle, and then slide the gluing section while touching the gluing section onto the first sheet to adhere glue to the predetermined area, and adhere glue only to a predetermined area on a second sheet stacked on the first sheet and subsequent sheets;

wherein the control section includes a glue supply mode in which the number of times glue is re-applied onto the first sheet of the sheet bundle is greater than the number of times glue is re-applied onto the second sheet; and where the control section applies the glue supply mode in a case in which a next glue binding is to be started after a given period of time elapses from the moment the previous glue binding is ended.

8. The sheet post processing apparatus according to claim 7, wherein the control section includes a glue supply mode in which, in the sheet bundle, the glue apply region on the first sheet is larger than the glue apply region on the second sheet, in the glue supply mode, the glue is started to be glued from the outside of the adhering region of the first sheet to the end of the adhering region.

* * * * *